US007905103B2

(12) United States Patent
Larsen et al.

(10) Patent No.: US 7,905,103 B2
(45) Date of Patent: Mar. 15, 2011

(54) MODEL PREDICTION CONTROLLED REFRIGERATION SYSTEM

(75) Inventors: Lars Finn Sloth Larsen, Sydals (DK); Claus Thybo, Soenderborg (DK)

(73) Assignee: Danfoss A/S, Nordborg (DK)

( * ) Notice: Subject to any disclaimer, the term of this patent is extended or adjusted under 35 U.S.C. 154(b) by 724 days.

(21) Appl. No.: 11/663,871

(22) PCT Filed: Sep. 30, 2005

(86) PCT No.: PCT/DK2005/000625

§ 371 (c)(1),
(2), (4) Date: Jul. 20, 2007

(87) PCT Pub. No.: WO2006/034718

PCT Pub. Date: Apr. 6, 2006

(65) Prior Publication Data

US 2008/0000241 A1 Jan. 3, 2008

(30) Foreign Application Priority Data

Sep. 30, 2004 (DK) ..... 2004 01494

(51) Int. Cl.
*F25B 49/02* (2006.01)

(52) U.S. Cl. ..... 62/228.5; 62/228.1; 62/157; 62/231; 62/126

(58) Field of Classification Search ..... 62/228.1, 62/228.5, 157, 231, 126
See application file for complete search history.

(56) References Cited

U.S. PATENT DOCUMENTS

| | | | | |
|---|---|---|---|---|
| 4,420,947 | A | 12/1983 | Yoshino | 62/160 |
| 7,147,168 | B1 * | 12/2006 | Bagwell et al. | 236/49.3 |
| 2002/0134094 | A1 * | 9/2002 | Huh et al. | 62/175 |
| 2003/0019230 | A1 | 1/2003 | Gether et al. | 62/238.7 |

FOREIGN PATENT DOCUMENTS

| | | | |
|---|---|---|---|
| EP | 0 999 418 | A2 | 1/1999 |
| JP | 05-264086 | A | 10/1993 |
| JP | 5264086 | * | 10/1993 |
| JP | 05264086 | A * | 10/1993 |
| JP | 07-269926 | A | 10/1995 |
| JP | 7269926 | * | 10/1995 |
| JP | 07269926 | A * | 10/1995 |

OTHER PUBLICATIONS

PCT Search Report for Serial No. PCT/DK2005/000625 dated Dec. 27, 2005.
Article entitled "Hybrid MPC in Supermarket Refrigeration Systems" by Lars F.S. Larsen, et al., 16th IFAC World Congress, www.ifac-control.org.

* cited by examiner

*Primary Examiner* — Cheryl J Tyler
*Assistant Examiner* — Jonathan Bradford
(74) *Attorney, Agent, or Firm* — McCormick, Paulding & Huber LLP

(57) ABSTRACT

The invention provides a refrigeration system with a compressing unit, and a method of controlling a refrigeration system. To facilitate a better control, the capacity of the compressing unit is controlled based on a predicted future cooling demand rather than an actually determined cooling demand. The invention further provides a system wherein a cost value for changing the cooling capacity of the system is taken into consideration.

20 Claims, 2 Drawing Sheets

MODEL PREDICTION CONTROLLED REFRIGERATION SYSTEM

CROSS REFERENCE TO RELATED APPLICATIONS

This application is entitled to the benefit of and incorporates by reference essential subject matter disclosed in International Patent Application No. PCT/DK2005/000625 filed on Sep. 30, 2005 and Danish Patent Application No. PA 2004 01494 filed Sep. 30, 2004.

FIELD OF THE INVENTION

The invention relates to a refrigeration system e.g. of the kind installed in supermarkets and comprising a plurality of refrigerated display cases or storage rooms, in the following in general referred to as refrigerated spaces. The system comprises a closed-loop system for circulation of a refrigerant between a compressing unit, a condenser, and one or more refrigerated spaces with evaporators for evaporation of the refrigerant. In particular, the invention relates to a system wherein the compressing unit comprises a variable capacity element, e.g. a plurality of standard reciprocating compressors or scroll compressors to provide a variable volumetric compressing capacity for compressing the refrigerant. The system provides a cooling capacity to meet a cooling demand to refrigerate the atmosphere of the refrigerated spaces, in the following referred to as the secondary fluid. The vapour of evaporated refrigerant is communicated at a suction pressure to an inlet of the compressing unit. The invention further relates to a method of controlling a refrigeration system.

BACKGROUND OF THE INVENTION

Large refrigerating systems, e.g. for supermarkets, typically have one single compressing unit with a plurality of compressors working in parallel to provide compressed refrigerant via a condenser to a plurality of refrigerated spaces. In the refrigerated space, the refrigerant is evaporated in an evaporator whereby the temperature of the ambience, i.e. the temperature of the secondary fluid, is decreased. To adjust the temperature in separate refrigerated spaces individually, each of the spaces has separate evaporators with adjustable inlet valves. Usually, the inlet valve is temperature controlled, i.e. the valve of a refrigerated space opens and closes based on the temperature of the secondary fluid. If liquid refrigerant by accident leaves the evaporator, the compressors can be severely damaged. For that reason, the above-mentioned valve is usually inserted serially with a thermostatic valve which changes the flow rate based on the superheat of the refrigerant at the outlet of the evaporator. The thermostatic valve thus ensures that the refrigerant which is released into the evaporator is completely evaporated when it leaves the evaporator.

After the evaporation, vapour of refrigerant from each of the refrigerated spaces is led to an intake of the compressing unit. At the intake, suction pressure generated by the evaporated refrigerant is measured by a pressure gauge. If the suction pressure is high, the evaporation temperature is also high, and the required cooling may not be available. On the contrary, if the suction pressure is low, the efficiency of the compressors is reduced. In a traditional system, the compressing capacity of the compressing unit, i.e. the specific amount of refrigerant which is compressed, is controlled based on the suction pressure. When the pressure reaches an upper level, the compressing capacity is increased by switching on additional compressors, and when the pressure reaches a lower level, the compressing capacity is decreased by switching out additional compressors.

In one specific implementation, the compressor capacity is controlled by a PID based structure using the actual suction pressure as feedback. The compressor capacity can be controlled by use of the following mathematical expression $$CC(t) = K_p\left(e(t) + \frac{1}{T_i}\int e(t)dt,\right) \quad \text{Equation 1}$$

with the control error $$e(t)=\text{suction pressure setpoint}(t)-\text{actual suction pressure}(t) \quad \text{Equation 2}$$

The compressor capacity control is divided into two terms, a proportional term and an integral term. The proportional part, shown as the first part of Equation 1, reacts directly on the actual control error. The integral term, shown as the last term of Equation 1, reacts on the integral of the control error. Hence, the integral term is responsible for eliminating steady state errors, and the proportional part reacts on set-point changes and control errors caused by changes in cooling demands. The tuning values Kp and Ti can be used to tune the controller to the system dynamics.

In a refrigeration system with more evaporators operating in hysteresis mode, the cooling demand varies much when the flow of refrigerant to the evaporators is switched in and out by an evaporator valve. This can have the undesirable effect on the compressor capacity control, that it will start or stop a compressor each time the evaporators switch in or out, which causes an increased wear on the compressors.

One problem is that the known PI or PID based compressor capacity control systems are only able to react in a causal way which in practice means that a short positive peak in the cooling demand can cause a start of a compressor, shortly after followed by a stop of the same or of another compressor of the system. In such a situation, a preferred operation would have been to continue without the starting and stopping of the compressor, i.e. to ignore the brief changes of the cooling demand.

In a system with discrete capacity values, one further problem related to a PID based controller is that the lower compressor capacity value will produce a small negative control error. The negative error causes the integral part to start a compressor whereby the control error becomes slightly positive with a compressor stop as a result. The effect can be seen as a limit-cycle on the compressor capacity, even with constant cooling demand. A remedy to avoid the limit-cycle can be to introduce a dead-band where the integral part is only updated when the numerical control error is larger than a given value. However, the general problem, i.e. that the PID based structure can only react in a causal way, remains.

In addition to the above mentioned problem of frequent compressor start/stop cycles, control of refrigeration systems is complicated by relatively long time constants. As an example, it takes long time from an evaporator valve is actuated until the temperature in a corresponding refrigerated space is changing, or it takes long time from a cover is removed from a refrigeration display case until the demand for additional cooling capacity is observed. On the other hand, the time it takes from the compressor capacity is changed to the change has an effect on the pressure on the suction side of the compressing unit, is relatively short.

In a refrigeration system of the kind mentioned in the introduction, fluctuations, e.g. due to switching of the evaporator valves are expected. An increased cooling demand could be caused by these fluctuations or it could be caused by a more permanent change of the cooling demand. If an increase is caused by fluctuation, it would not be suitable to change the compressor capacity, whereas if the change is of a more permanent nature, the compressor capacity should be changed. A traditional system, e.g. a PI(D) based system is not capable of determining if a cooling demand is caused by fluctuation, and in some cases, a traditional system would therefore react on fluctuation by regulating the compressor capacity by switching a compressor on or off unnecessarily, whereby compressor wear increases.

SUMMARY OF THE INVENTION

It is an object of the invention to enable better control of a refrigeration system. Accordingly, the invention provides a system of the kind mentioned in the introduction, characterised in that the system further comprises a control system adapted:

to establish an estimate of a future cooling demand, and to control the cooling capacity to adapt to the estimate.

Since the cooling capacity is controlled to compensate for future changes in the cooling demand in contrast to the traditional systems wherein the compressing capacity is controlled based on an actually needed cooling capacity, a better control with less changes to the compressing capacity can be achieved. Since each change in the capacity implies wear on the compressing unit, the invention further facilitates a more economical operation of the system. Depending upon the implementation, one advantage of the invention could be that it facilitates a non-causal reaction to set-point changes and disturbances. Where a traditional, e.g. PID based, control approach in refrigeration systems reacts on disturbances when they occur, a system according to the present invention employ estimates of future disturbances to optimize the control action. Hence the controller can react to disturbances before they occur and thereby reduce the effects of the disturbances. Another advantage over PID based control could be the ability to compensate for saturations, such as a maximum compressor capacity. If future saturation is predicted, the controller can adjust the pre-saturated control action to compensate for the future saturation. This enables an optimal sequence of control actions, also referred to as a trajectory of actions, taking the saturations into account. In practice, the refrigerated space may be cooled to a temperature which is lower than an actually desired set-point temperature in order to compensate for a predicted future cooling demand which exceeds the available cooling capacity of the system.

The cooling capacity may be controlled by controlling at least one of the compressing capacity and the mass flow through the evaporators. The compressing capacity could be controlled e.g. in discrete steps by switching a compressor on or off, or the compressing capacity could be controlled by varying the displacement performed by the compressing unit(s), e.g. by varying the rotational speed of a piston or scroll compressor. The mass flow could be varied via an inlet valve controlling the flow through the evaporator.

During filling of the evaporator, the flow of the refrigerant is preferably controlled to achieve a minimum superheat region. For this purpose, a thermostatic expansion valve or an electronically controlled valve is inserted e.g. in an inlet of the evaporator. The evaporator will produce the maximum cooling capacity for the given operation condition. The temperature of the secondary fluid of the refrigerated space is controlled e.g. by a hysteresis control which switches said filling control on and off to keep the air temperature within the desired temperature band. For a fixed value of the compressing capacity and flow of refrigerant, the cooling capacity depends on the temperature difference between the evaporating temperature and the temperature of the secondary fluid. The compressor control affects the operation conditions by controlling the suction pressure to achieve a desired evaporation temperature. Hence, the objective of the compressor control is to achieve a suction pressure that produces an evaporating temperature that enables the system to meet the cooling demands. If the evaporating temperature is too close to the temperature of the secondary fluid, the system cannot meet the cooling demand. A too low evaporating temperature is undesirable because the compressor uses more energy than necessary because the pressure difference between the inlet and outlet is increased.

The estimated future cooling demand could be comprised in a mathematical model which gives the cooling estimate based on a time of the day, or the cooling estimate could be logged in a table, e.g. with corresponding values of time and estimated demand, e.g. for an hour, a day, or a year. A prediction of future cooling demands can be established in different ways. Examples are:

by observing past changes in cooling demands. This can be done by estimating the mass-flow of refrigerant through the compressor by using the suction pressure and compressor capacity as input to a model of the refrigeration system. Calculating the inlet and outlet specific enthalpy can be done by using temperature and pressure as input to a refrigerant specific enthalpy function. Future cooling demands can then be predicted based on the past values. This will enable capturing of demand variations during a 24 hour, a weekly, or a yearly cycle.

by logging past measurement of physical entities such as the temperature of the spaces in which the refrigeration system is installed, e.g. the temperature of a supermarket. From said logged values, a model of how the physical entities influence the cooling demands can be established. Using the model and predictions of the physical entities, the future cooling demands can be predicted.

by establishing a theoretical model of how said physical entities influence the cooling demands. Using the theoretical model and prediction of said physical entities such as a local weather forecast to predict future cooling demands.

It is preferred to achieve the predicted cooling effect while maintaining the suction pressure with a low variance. At the same time, it is preferred to keep the number of compressor start/stops at a minimum. The reason for keeping a steady suction pressure is that the evaporating temperature is directly functionally dependent on the suction pressure and that a steady evaporating temperature makes the refrigeration system operate more efficiently. The reason for minimizing the number of compressor start/stops is that compressor starts increase the wear on the compressors.

From the prediction of the cooling demand, it is possible to reduce the number of start/stops and at the same time it is possible to reduce the variance of the evaporating temperature compared to a conventional PID based controller.

In case of a short peak in the cooling demand, a conventional PID controller detects the rise of the cooling demand and will thus increase the cooling capacity. After the peak, the conventional PID detects the reduction of the cooling demand and therefore reduces the cooling capacity. In the system according to the present invention, the controller will take a future demand into account, and base the cooling capacity on an optimum for the predicted time horizon. Hence, a short peak will typically not cause a change of cooling capacity, but a more permanent change of cooling demand will cause a swift change of capacity to match the demand.

The control system may have a computer processing unit, CPU, and data storage means to establish a first data set comprising predicted future values of cooling demands and thus demands of compressing capacities, e.g. at different points in time. The control system may further contain other sets of data, e.g. in the form of mathematical models or tables from which a specific cooling demand can be derived e.g. based on external operating conditions. Such external conditions may embrace: an outside temperature, a general atmospheric humidity in the environment of the refrigeration system, a number of customers entering the space, e.g. a supermarket, to which the refrigeration system belongs, the arrival of new items to the refrigerated spaces of the supermarket or more simply, the time of the day.

The first and other data set(s) could be established based on data recorded during previous operation of the system, e.g. data which are logged at specific points in time of the day, e.g. in combination with knowledge about an opening hour of the supermarket, knowledge about a time of arrival of new products for the refrigerated spaces etc. All of these external operating conditions could be logged in a second data set.

The compressing unit could have any number of compressors of any kind, e.g. reciprocating compressors, rotary compressors, or scroll compressors. One or more of the compressors could have variable speed, and they could be individually turned on and off by the control system. The evaporators could be regular evaporators of the kind known from existing display cases in supermarkets. The evaporators have valves which are operated e.g. based on the temperature of the refrigerant when it leaves the evaporator, e.g. a thermostatic expansion valve. The evaporators may also have valves which are operated by a signal from the control system, typically a Pulse Width Modulated (PWM) solenoid valve. In the last-mentioned case, the control system may further be in communication with temperature sensing means for sensing the temperature of the secondary fluid in the refrigerated spaces, and with means for determining the superheat of the refrigerant leaving the evaporator.

The cooling capacity depends on the suction pressure, the mass flow of the refrigerant, the evaporation pressure and the condensation pressure. However, future values of the suction pressure in combination with a value of the mass flow can, in one embodiment, express the future values of the cooling demand or it may express required future compressor capacities. In this embodiment, the suction pressure and the mass flow are therefore the controlled variables. In practice, both of these variables may be varied to obtain a future cooling capacity, or one of the variables may be fixed to a specific value while the other variable is varied to obtain the desired cooling capacity. Throughout this document, the suction pressure is mentioned as a controlled variable. This is implicitly understood to be with a fixed mass flow, and in any of the examples, the suction pressure may be substituted with the mass flow as the controlled variable. In one example, a first data set of the controller comprises expected values of suction pressures for different points in time, and the values are determined e.g. based on the previously recorded suction pressures for corresponding external operating conditions. As an example, the controller may comprise a table with values of outside temperatures, expected arrival of articles for the refrigerated spaces, humidity etc, and corresponding values of suction pressures. From an actually measured external condition and the table, the controller could be capable of predicting a future suction pressure and to control the compressing capacity in accordance therewith.

In a simple implementation, the second data set comprises values of cooling capacities or values of suction pressures and mass flow which have previously been recorded at different points in time. By use of a clock and the previously recorded cooling capacities, the CPU can predict future values of cooling demands. As mentioned previously, the suction pressure and mass flow may influence the cooling capacity and may therefore in certain embodiments be used to express the cooling capacity. In a traditional system, the level of the suction pressure may have caused an increase or a decrease in the compressing capacity. In a system according to the invention, however, an approaching change in the suction pressure may be predicted, and in some cases this change renders the change in capacity unnecessary.

In a preferred embodiment, the controller comprises a cost function that assigns costs to deviation of the controlled variable (suction pressure and/or mass flow) from the set-point. It can also include other entities that need to be considered in an optimal control such as the number of compressor start/stops. A prediction horizon is considered, and the horizon is divided into a number of time steps. A control action is assigned to each time step and a cost value associated with operation of the system according to the control action and within the time step is determined. The costs for operating the system in all time steps according to the sequence of control actions are summed up. A similar calculation is made with respect to sequences of alternative control actions, and the sequence which gives the lowest costs is selected, and the system is controlled in accordance with the first control action of this sequence of actions. Subsequently, the calculation is repeated for a horizon which is shifted one time step forward.

By means of the costs, it is considered how close the cooling capacity is to the cooling demand, i.e. a difference between the demanded and the achieved cooling capacity is given a cost value, and this cost value is compared with a cost value associated with an attempt to reduce the difference. As an example, the cooling capacity may be insufficient, but it may be considered too expensive to reach a higher capacity taking a predicted future demand into consideration. This we will be explained in further details later.

In this embodiment, the controller works by identifying a set of compressor capacities that minimizes said cost function using a model of the system, said cooling demand predictions, and actual system measurements. The first compressor capacity of the set is used as the control action. At the next time instance the procedure is repeated using new system measurement and updated demand predictions.

Identifying the optimal set of compressor capacities can be achieved using different methods.

A basic method implements a least square method which solves the unconstraint optimizing problem. It is desirable to include compressor capacity constraints, whereby solutions containing capacities outside the obtainable region (0-100%) can be avoided. Details on the least square methods can be found in "Predictive Control with Constraints" by J. M. Maciejowski, Prentice Hall.

Defining the convex optimizing problem as quadratic programming problem, this can be described as a "going downhill" algorithm. The problem with the quadratic programming problem is that it assumes that the compressor capacity can be assigned continuous values. This is in contradiction to most compressor control systems, where the capacity only can take quantified values by stopping and starting compressors. The optimality guarantee is lost when quantifying the optimal capacities. Hence, a graph-search method can be utilized to explore the prediction trajectory. Due to the limited number of capacity values, the number of possible states grows with the number of possible new capacity values from a given state. This limits the number of prediction steps which must be investigated. One approach is to apply a grid with comparable states assigned to a cell in the grid. For each cell in the grid, the state with the lowest cost value can be selected, and the other states with higher costs can be disregarded for that grid. This limits the number of states to a maximum of the number of the cells multiplied with the number of new capacity values and therefore facilitates faster data processing in the controller. Accordingly, one embodiment of the invention relates to a system which is adapted to determine:

a first switching sequence compressing a first element of a first time step, the element being indicative of an increased compressing capacity compared with a compressing capacity of a previous time step, a second switching sequence compressing a first element of the first time step, the element being indicative of an unchanged compressing capacity compared with a compressing capacity of a previous time step, and a third switching sequence compressing a first element of the first time step, the element being indicative of an decreased compressing capacity compared with a compressing capacity of a previous time step and for each of the first, second and third switching sequences, the system is adapted to add elements being indicative of an increased, an unchanged, and a decreased compressing capacity, respectively. The system thereby determines 3M (3 raised to the power of M) switching sequences each comprising M elements each being indicative of an increased, an unchanged, and a decreased compressing capacity in an Mth time step compared with a compressing capacity of a previous, (M−1)th, time step.

The system being further adapted to determine for each of the switching sequences a cooling capacity which is derivable by the switching sequence and a cost value representing the cost of operating the system in accordance with the switching sequence. The system may further be adapted to select a cheapest mode of operating the system being the one out of the switching sequences with the lowest cost value.

The system being further adapted to control the compressing unit in accordance with the cheapest mode of operation, at least for a period of time corresponding to the first time step by controlling the compressing unit to provide the compressing capacity of the first element in the switching with the lowest cost value.

The procedure can be continued for any number of subsequent time steps, and preferably, the procedure is repeated each time the system has been controlled at least for a period of time corresponding to the first time step.

With respect to the computing capacity of the CPU, the reduction in the amount of data is an advantage. To further facilitate computation, the number of M cooling capacities could be grouped into groups of specific ranges of cooling capacities, and for each group, one cheapest mode of operation could be selected e.g. for each time step or for each specific number of time steps. After a number of time steps, the outcome of the described process could be a large number of switching sequences and corresponding cooling capacities. By grouping this number into a relatively low number of groups, e.g. into 2, 3, 4 or more groups wherein each group comprises cooling capacities within a specific range, and by selecting one single, cheapest, mode of operation for each group, the amount of data for calculating the next time step is reduced to that selected number of groups, and the calculation can thereby be simplified.

As mentioned previously, an increased wear occurs each time a compressor is turned on. The cost involved with operation of a compressing unit therefore not only depends on the energy which is consumed by the compressor(s) during operation, but it also depends on the number of changes to the compressing capacity. Accordingly, the cost value could comprise not only the costs of operating the compressing unit in accordance with the switching sequences, but also the costs of the switching between the compressing capacities included in the switching sequences.

In one embodiment, the controller calculates a difference between the cooling capacities derived by each of the switching sequences and a predicted cooling demand i.e. what is predicted to be a required cooling capacity at the specific point in time—i.e. after the M time steps. Based on the difference, the controller calculates cost values representing the costs of operating the system with these differences between the required cooling capacity and the capacities derived by the switching sequences. The system includes in theses cost values, values representing the costs of the required switching compressors on or off according to the switching sequences. At the end, the controller controls, at least in the first time step, the compressors in accordance with the sequence giving the lowest costs, i.e. taken the difference and the switching into account.

The length of the time-steps may be of equal size, e.g. equal to five times a dynamic time constant of a response to the control of the compressing capacity. A shorter sampling-step requires more prediction steps to reach the same prediction horizon, and if the sampling-step is selected much longer, the controller will not be able to react to changes as fast.

In a second aspect, the invention provides a method of operating a refrigeration system of the kind mentioned in the introduction, the method comprising the steps of:

estimating of a future cooling demand, and controlling the cooling capacity to adapt to the estimate.

The method could further comprise any step corresponding to the features mentioned in connection with the first aspect of the invention.

BRIEF DESCRIPTION OF THE DRAWINGS

In the following, the invention will be described in further details with reference to the drawing in which.

DETAILED DESCRIPTION OF THE INVENTION

In a typical refrigeration system, the cooling demand varies significantly during operation. In a supermarket system, night covers may shield the refrigerated spaces during closing hours. In this event, the cooling demand is typically reduced. On the contrary, the cooling demand is increased when the supermarket opens, and the staff and customers start to move goods into, or out of the refrigerated spaces.

If the refrigerated spaces have been loaded with warm goods or when over stacking the goods, the cooling demand is significantly increased. Also, since the sensible load is increased by high surrounding temperatures, such high temperatures cause a higher cooling demand. Similarly, a high absolute humidity gives a higher cooling demand because of the increased latent load when some of the cooling is used to condensate the humidity or to build up ice in the evaporator.

Figure 1:
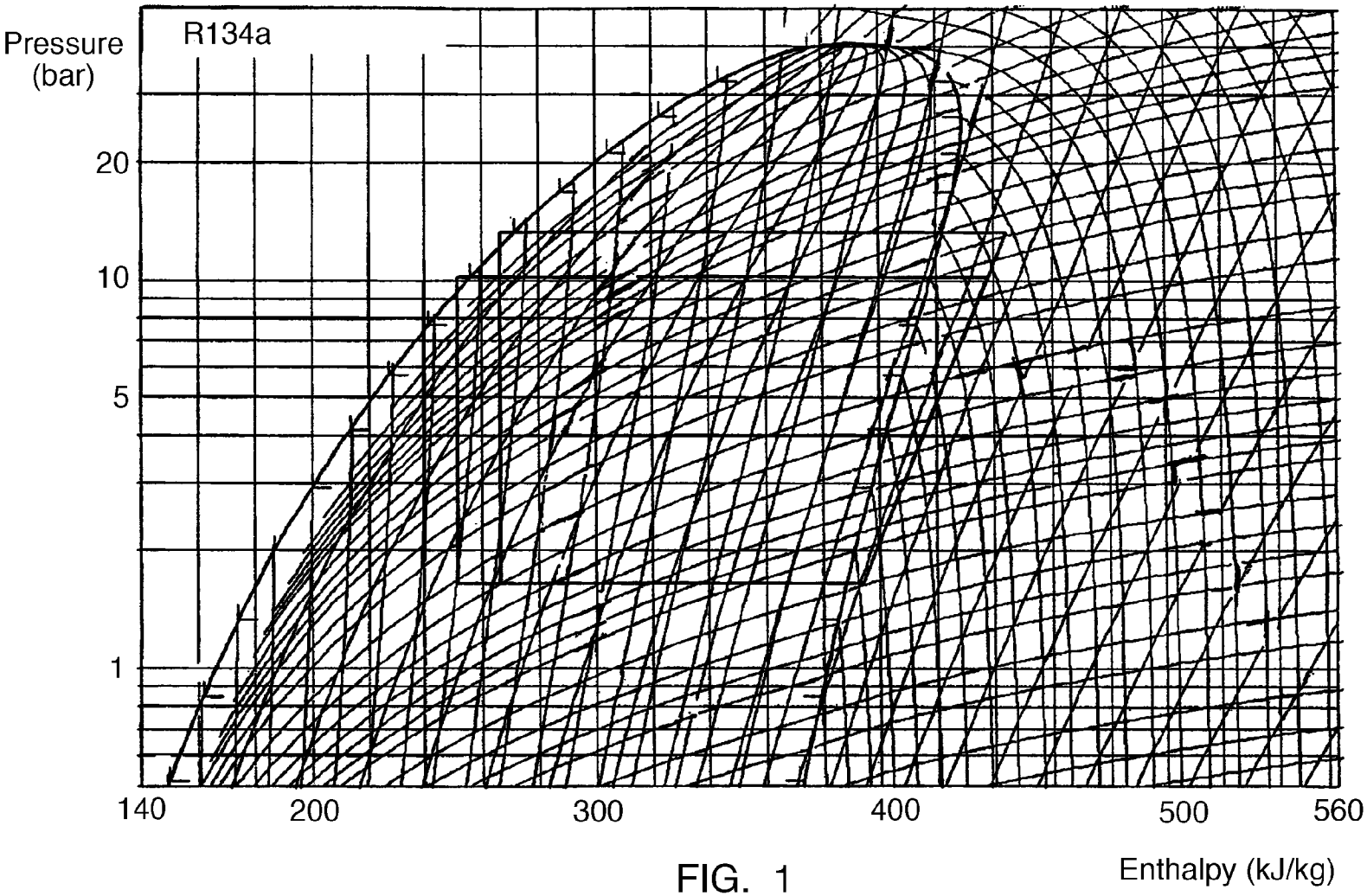
FIG. 1 illustrates the effect on the evaporator enthalpy difference when the condenser pressure is increased.

A higher outdoor temperature does not change the cooling demand, but it may increase the condensing temperature. Such an increase may reduce the enthalpy difference in the evaporator, and may reduce the efficiency of the refrigeration system. The cooling capacity can be expressed as the product of the enthalpy difference of the refrigerant while passing the evaporator and the mass-flow of the refrigerant through the evaporator. Hence, to maintain a constant cooling capacity, the refrigerant mass flow must be increased to compensate for the decrease of said enthalpy difference. FIG. 1 illustrates the effect on the evaporator enthalpy difference when increasing the condenser pressure. It shows that the inlet enthalpy is increased, but the outlet enthalpy is not affected.

Figure 2:
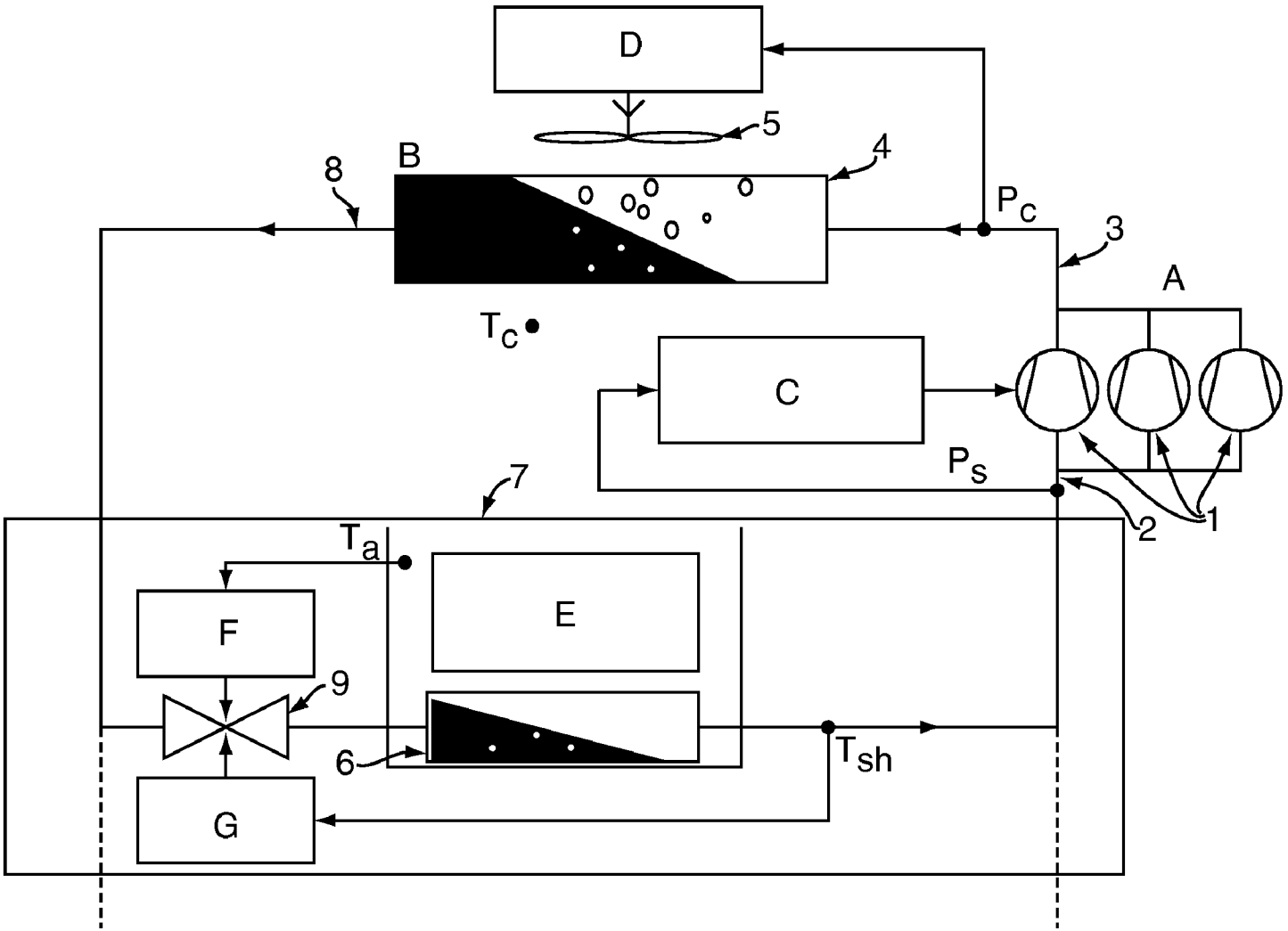
FIG. 2 shows a diagrammatic view of a system according to the invention.

FIG. 2 shows a refrigeration system, e.g. for a supermarket. The system comprises a compressing unit A with a plurality of compressors 1 coupled in parallel between an intake 2 and an outlet 3. The compressing capacity of the compressing unit is adjustable. The capacity is adjusted discretely by switching single compressors on or off. In more advanced systems, however, the capacity of single compressors can be adjusted by regulating the compressors speed, e.g. via a frequency converter. The outlet manifold is connected to an inlet of a condenser 4 in which the compressed refrigerant is condensed. The condenser comprises a condenser control, D, which controls a fan 5 to adjust the heat exchange between the condenser and the surrounding atmosphere. The evaporators 6 of a plurality of refrigeration display cases 7 (of which only one is shown) are coupled in parallel to an outlet 8 of the condenser to receive the condensed refrigerant. Each refrigeration display case comprises an evaporator and an inlet valve 9 capable of adjusting a flow rate of the condensed refrigerant entering the evaporator. The energy which is necessary to evaporate the refrigerant is drawn from the interior, E, of the refrigeration display cases in which the temperatures thereby are reduced. Vapour of refrigerant from each of the refrigeration display cases are collected at the intake 3 of the compressing unit A. The control unit F on/off controls the valve to either open or close passage of refrigerant to the evaporator based on the temperature in the display case. The control unit G controls the valve based on the superheat of the refrigerant. As an input, the control unit G receives a temperature difference TSH between the evaporation temperature of the refrigerant when it enters the evaporator and the temperature of the refrigerant when it leaves the evaporator.

At the intake 3, suction pressure of the evaporated refrigerant is measured by the pressure gauge, and a pressure signal is communicated to the control unit, C.

In a regular control system, the compressing capacity is controlled to maintain a suction pressure within a certain range, c.f. the previous description of the background of the invention. When the pressure reaches an upper level, the compressing capacity is increased by switching on additional compressors, and when the pressure reaches a lower level, the compressing capacity is decreased by switching off additional compressors. Correspondingly, the inlet valves 9 of each of the refrigeration display cases 7 are controlled based on the temperature of the associated refrigeration display cases.

In accordance with the invention, the control unit C is also connected to the inlet valves 9 of the refrigeration display cases 7. The control unit comprises a calculating unit and data storage means, and during operation, it is adapted to establish a first data set comprising predicted future values of suction pressures at different points in time. The prediction is calculated based on a second data set representing predicted future operating conditions for the refrigeration system. As an example, the second data set comprises meteorological data, e.g. various temperatures at specific points in time, or the second data set comprises information about an amount of items which in the future will be received in the refrigeration display cases at specific points in time or information about opening hours of the supermarket, at which time isolating hatches of the refrigeration display cases are removed.

Example 1

In the following, an example of a set of control algorithms for a refrigeration system according to the invention is presented for a system wherein the controller is adapted to optimize a cost function representing the costs of operating the system. In the cost function, the energy which is consumed by the compressors during operation and the wear on a compressor caused by a startup of the compressor is taken into consideration.

By formulating an objective function (=cost function), an optimal control sequence can be computed for a specified prediction horizon (N). This is done by finding a future control sequence that minimizes the objective function. In the objective function, the different objectives for the control can be weighted and thereby taken into account in controlling of the system.

In a supermarket refrigeration system an objective function may take the compressor capacity as an input and may read as follows:

$$J(k) = \underbrace{W \cdot \sum_{i=1}^{N} \|P_{suc}(T(k+i) \mid Tk) - P_{suc,ref}(T(k+i) \mid Tk\|^2 \ldots +}_{\text{Weighed deviation from the wanted suction pressure } (P_{suc,ref})}$$

$$\underbrace{R \cdot \sum_{i=1}^{N} \|Cc(T(k+i) \mid Tk) - Cc(T(k+i-1) \mid Tk\|^2 \ldots +}_{\text{Weighed shift in the compressor capacity (Comp.cap)}}$$

$$\underbrace{P \cdot \sum_{i=1}^{N} \|Cc(T(k+i) \mid Tk)\|^2}_{\text{Weghting large compressor capacities}} \qquad \text{Equation I}$$

Where

| | |
|---|---|
| $P_{suc}$ | Suction pressure |
| $P_{suc,ref}$ | Suction pressure reference |
| W | Weight for punishing deviation s from the suction pressure reference |
| Cc | Compressor capacity (defined as the actual percentage of the max. capacity |
| R | Weight for punishing large variation s on the compressor capacity |
| P | Weight for punishing large compressor capacities |
| N | Prediction horizon |
| k | Sample number |
| i | Counting variable |
| T | Sample time |

Notations:

$\|v\|^2$ specifies the 2-norm which is the squared absolute length of the vector v. $P_{suc}(T(k+1)/Tk)$ specifies the predicted value of $P_{suc}(T(k+1))$ where the prediction is done at time Tk.

In equation 1, the objective is to keep the suction pressure ($P_{suc}$) close to the reference ($P_{suc,ref}$) without any large variation in the compressor capacity (Cc) and using only small compressor capacities. Other objectives could, however, be taken into account, e.g. by adding more terms in the objective function.

If estimates of the future required cooling demand ($\dot{Q}_{req}$) is available, these can be taken into account while computing the future compressor capacities (Cc).

The mass flow in the refrigeration system can be computed as $$\dot{m}=Cc_{max}\cdot(Cc/100)\cdot\eta_{vol}\cdot V_{sl}\cdot\rho_{suc}(P_{suc},SH) \quad \text{Equation 2}$$

However, the mass flow may as previously mentioned be controlled by a valve, and the control of this valve may thus also determine the mass flow when the pressure drop over the valve and the valve characteristics are known. If the system comprises a plurality of refrigerated spaces which are individually fitted with a valve, the mass flows through the valves has to be summed up to achieve the total mass flow in the system.

In this function, Cc is defined in percentage of maximum capacity Ccmax of the compressor(s).

where

| | |
|---|---|
| $Cc_{max}$ | Maximum capacity of the compressor(s) |
| $\eta_{vol}$ | Volumetric efficiency |
| $P_{sl}$ | Stroke volume of the compressor |
| SH | The superheat at the inlet of the compressor |
| $\rho_{suc}$ | Density of the refrigerant at the inlet of the compressor (typically as a function of the suction pressure and the superheat (SH) |

The actual cooling capacity is given by:

$$\dot{Q}_{act}=\dot{m}\cdot\Delta h(P_c,P_{suc},SH,SC) \quad \text{Equation 3}$$

Where

| | |
|---|---|
| Δh | Increase of enthalpy in the refrigerant across the evaporator (typically as a function of the condensing pressure, the suction pressure, the superheat, and the sub-cooling) |
| $P_c$ | Condensing pressure |
| SC | The sub-cooling at the outlet of the condenser |

If it is assumed that the superheat (SH) and the condensing pressure ($P_c$) is controlled to specific values by other controllers, they can be assumed constant. The sub-cooling (SC) is typically defined at least substantially by the mechanical construction of the refrigeration system and SC is therefore assumed to be constant. In a more advanced implementation, SH, $P_c$ and SC are measured at each time step.

Combining Equation 2 and Equation 3 and assuming SH, $P_c$, and SC are constant, the following can be obtained:

$$\dot{Q}_{act}=Cc_{\max}\cdot\frac{Cc}{100}\cdot\eta_{vol}\cdot V_{sl}\cdot\rho_{suc}(P_{suc})\cdot\Delta h(P_{suc}) \quad \text{Equation 4}$$

Wherein Cc is defined in percentage of maximum capacity for the system.

Assuming that the required cooling demand ($\dot{Q}_{req}$) is known for a number of N steps into the future that is:

$$\left.\begin{array}{c}\dot{Q}_{req}(T(k+1))\\ \dot{Q}_{req}(T(k+2))\\ \vdots\\ \dot{Q}_{req}(T(k+N))\end{array}\right\}\text{known!}$$

Then in order to meet the request for the required cooling demand the actual cooling capacity should be the same for each time step (1 to N) that is:

$$\begin{array}{c}\dot{Q}_{req}(T(k+1))=\dot{Q}_{act}(T(k+1))\\ \dot{Q}_{req}(T(k+2))=\dot{Q}_{act}(T(k+2))\\ \vdots\\ \dot{Q}_{req}(T(k+N))=\dot{Q}_{act}(T(k+N))\end{array}$$

Inserting Equation 4 gives:

$$\begin{array}{c}\dot{Q}_{req}(T(k+1))=Cc_{\max}\cdot Cc(T(k+1))/100\cdot\eta_{vol}\cdot V_{sl}\cdot\rho_{suc}\\ (P_{suc}(T(k+1))\cdot\Delta h(P_{suc}(T(k+1))\\ \dot{Q}_{req}(T(k+2))=Cc_{\max}\cdot Cc(T(k+2))/100\cdot\eta_{vol}\cdot V_{sl}\cdot\rho_{suc}\\ (P_{suc}(T(k+2))\cdot\Delta h(P_{suc}(T(k+2))\\ \vdots\\ \dot{Q}_{req}(T(k+N))=Cc_{\max}\cdot Cc(T(k+N))/100\cdot\eta_{vol}\cdot V_{sl}\cdot\rho_{suc}\\ (P_{suc}(T(k+1))\cdot\Delta h(P_{suc}(T(k+N))\end{array} \quad \text{Equation 5}$$

That is: the objective function (Equation 1) should be minimized under the constraint that Equation 5 is fulfilled:

$$\begin{array}{l}\text{Minimize}\quad J(k)=W\cdot\sum_{i=1}^{N}\left\|\begin{array}{c}P_{suc}(T(k+i)\mid Tk)-\\ P_{suc,ref}(T(k+i)\mid Tk)\end{array}\right\|^2\ldots+\\ R\cdot\sum_{i=1}^{N}\left\|\begin{array}{c}Cc(T(k+i)\mid Tk)-\\ Cc(T(k+i-1)\mid Tk)\end{array}\right\|^2\ldots+\\ P\cdot\sum_{i=1}^{N}\|Cc(T(k+i)\mid Tk)\|^2\end{array} \quad \text{Equation 6}$$

*s.t.*

$$\begin{array}{c}\dot{Q}_{req}(T(k+1))=Cc_{\max}\cdot Cc(T(k+1))/100\cdot\eta_{vol}\cdot V_{sl}\cdot\rho_{suc}\\ (P_{suc}(T(k+1))\cdot\Delta h(P_{suc}(T(k+1))\\ \dot{Q}_{req}(T(k+2))=Cc_{\max}\cdot Cc(T(k+2))/100\cdot\eta_{vol}\cdot V_{sl}\cdot\rho_{suc}\\ (P_{suc}(T(k+2))\cdot\Delta h(P_{suc}(T(k+2))\\ \vdots\\ \dot{Q}_{req}(T(k+N))=Cc_{\max}\cdot Cc(T(k+N))/100\cdot\eta_{vol}\cdot V_{sl}\cdot\rho_{suc}\\ (P_{suc}(T(k+1))\cdot\Delta h(P_{suc}(T(k+N))\end{array}$$

Solving this optimization problem gives a vector containing the sequence of future control actions (Cc) for the N-step prediction horizon:

$$\begin{array}{c}Cc(T(k+1))\\ Cc(T(k+2))\\ \vdots\\ Cc(T(k+N))\end{array}$$

In a typical implementation only the first control signal in this sequence (Cc(T(k+1)) ) is applied, at the next time step new measurements are taken and the optimization program is solved once again based on the updated measurements. In some applications more than only the first control signal could be applied to save computation time.

A more detailed theoretical description is presented in a technical paper with the title "Hybrid MPC In Supermarket Refrigeration Systems" by Lars F. S. Larsen, Tobias Geyer and Manfred Morari. The article was published at the 16$^{th}$ IFAC World Congress cf. www.ifac-control.org. The article can be downloaded from http://control.ee.ethz.ch/index.cgi?page=publications&action=list&publty=all&ifagroup=7

The article is hereby incorporated by reference.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A refrigeration system comprising a closed-loop system for circulation of a refrigerant between a compressing unit comprising a variable capacity element to provide a variable volumetric compressing capacity for compressing the refrigerant, and at least one evaporator for evaporating the compressed refrigerant and thus for providing a cooling capacity to meet a cooling demand to refrigerate a secondary fluid of a refrigerated space, a control system adapted:

to establish an estimate of a future cooling demand, and to control the cooling capacity to adapt to the estimate, wherein the control system is adapted to determine a cost value representing costs of operating the system by identifying a set of compressor capacities that minimizes a cost function by use of:

a model of the system, said cooling demand predictions, and actual system measurements, and wherein the cost function includes at least a first term representing the cost of operating the compressing unit and at least a second term representing the cost of switching between compressor capacities of the set of compressor capacities.

2. The system according to claim 1, wherein the first compressor capacity of the set of compressor capacities is used as the control action, and wherein the procedure is repeated in a subsequent time step using new system measurement and updated demand predictions.

3. The system according to claim 1, wherein the cooling capacity is controlled by controlling the compressing capacity.

4. The system according to claim 1, wherein the cooling capacity is controlled by controlling a mass flow of the refrigerant through the evaporator.

5. The system according to claim 1, wherein the compressing capacity is controlled in discrete steps.

6. The system according to claim 1, adapted to control the compressing capacities based on the cost value.

7. The system according to claim 1, wherein the control system comprises a data set representing future external operating conditions, and wherein the control system is adapted to establish the estimate of the future cooling demand from the external operating conditions.

8. The system according to claim 7, being adapted to record external operating conditions and corresponding cooling demands during operation.

9. A method for controlling a refrigeration system comprising a closed-loop system for circulation of a refrigerant between a compressing unit with a variable compressor capacity for compressing the refrigerant, and at least one evaporator for evaporating the refrigerant, the method comprises the steps of:

estimating of a future cooling demand, and controlling the cooling capacity to adapt to the estimate wherein the step of controlling the cooling capacity comprises:

within a time horizon, calculating a cost function for a number of trajectories of sequences of possible compressor capacities within the time horizon, the cost function including at least a first term representing the cost of operating the compressing unit and at least a second term representing the cost of switching between compressor capacities of the set of compressor capacities, selecting from the trajectories a trajectory with a lowest cost value, and selecting an initial cooling capacity of the selected trajectory and controlling the compressing unit or the mass flow of the refrigerant to provide that capacity.

10. The method according to claim 9, wherein the estimated future cooling demand is comprised in at least one of a mathematical model and a table.

11. The method according to claim 9, wherein the cooling capacity is controlled by controlling the compressing capacity.

12. The method according to claim 9, wherein the cooling capacity is controlled by controlling a mass flow of the refrigerant through the evaporator.

13. The method according to claim 9, wherein the cost value depends on a predicted cooling demand and an estimated cooling capacity.

14. The method according to claim 9, wherein the cost value is established as an accumulation of cost contributions of time frames within the time horizon.

15. The method according to claim 14, wherein a trajectory of subsequent cooling capacities of each of the time frames is selected based on cost contributions of the time frames.

16. The method according to claim 9, wherein the estimate is expressed as a product of a mass flow of the refrigerant through the evaporator and a change in specific enthalpy of the refrigerant through the evaporator.

17. The method according to claim 16, wherein the estimate is proportional with the mass flow.

18. The method according to claim 16, wherein the estimate is proportional with the compressing capacity.

19. The method according to claim 9, wherein the steps are repeated for a subsequent time horizon.

20. The method according to claim 9, wherein the cost value is established as an accumulation of cost contributions of time steps within the time horizon.

* * * * *